US007698791B2

(12) United States Patent
Pezza

(10) Patent No.: US 7,698,791 B2
(45) Date of Patent: Apr. 20, 2010

(54) SAFETY STRAP BUCKLE, IN PARTICULAR FOR AUTOMOTIVE CHILD SAFETY SEATS

(75) Inventor: Elsa Angelina Caterina Pezza, Brandizzo (IT)

(73) Assignee: Sabelt S.p.A., Turin (IT)

( * ) Notice: Subject to any disclaimer, the term of this patent is extended or adjusted under 35 U.S.C. 154(b) by 385 days.

(21) Appl. No.: 11/452,448

(22) Filed: Jun. 13, 2006

(65) Prior Publication Data

US 2007/0283539 A1 Dec. 13, 2007

(51) Int. Cl.

| | |
|---|---|
| ***A44B 11/25*** | (2006.01) |
| ***A44B 11/26*** | (2006.01) |
| ***B60R 22/10*** | (2006.01) |
| ***B60R 22/00*** | (2006.01) |

(52) U.S. Cl. ..... 24/579.11; 24/629; 24/633

(58) Field of Classification Search ..... 24/629, 24/633, 640, 642, 652–656, 579.11
See application file for complete search history.

(56) References Cited

U.S. PATENT DOCUMENTS

| | | | | | |
|---|---|---|---|---|---|
| 3,522,640 | A | * | 8/1970 | Lohr | 24/656 |
| 3,675,281 | A | * | 7/1972 | Stephenson | 24/656 |
| 3,807,000 | A | * | 4/1974 | Weman | 24/655 |
| 3,969,795 | A | * | 7/1976 | Stephenson | 24/655 |
| 4,128,924 | A | * | 12/1978 | Happel et al. | 24/655 |
| 4,196,500 | A | * | 4/1980 | Happel et al. | 24/655 |
| 4,228,567 | A | * | 10/1980 | Ikesue et al. | 24/642 |
| 4,457,052 | A | * | 7/1984 | Hauber | 24/656 |
| 4,617,705 | A | * | 10/1986 | Anthony et al. | 24/642 |
| 5,023,981 | A | * | 6/1991 | Anthony et al. | 24/642 |
| 5,813,097 | A | * | 9/1998 | Woellert et al. | 24/642 |

FOREIGN PATENT DOCUMENTS

| | | |
|---|---|---|
| EP | 0 867 131 A1 | 9/1998 |
| IT | TO 2003A001005 | 12/2003 |
| TO | 2003A001005 | 6/2005 |

OTHER PUBLICATIONS

Bibliographic Information for TO2003A001005, 1 page, (Oct. 21, 2009).

* cited by examiner

*Primary Examiner*—Robert J Sandy
(74) *Attorney, Agent, or Firm*—Blakely, Sokoloff, Taylor & Zafman LLP

(57) ABSTRACT

The buckle has a buckle body, and a lock mechanism for releasably locking two tongues insertable inside the buckle body in a longitudinal insertion direction; the lock mechanism includes a retaining rod movable, in a release direction perpendicular to the longitudinal insertion direction, between a lock position engaging retaining seats formed in the two tongues, and a release position disengaging the two tongues to permit expulsion of the tongues from the buckle body; the lock mechanism also includes a release button movable in the release direction to move the retaining rod into the release position; and the retaining rod is movable in the release direction independently of the release button, and is maintained in the lock position by a spring.

9 Claims, 5 Drawing Sheets

SAFETY STRAP BUCKLE, IN PARTICULAR FOR AUTOMOTIVE CHILD SAFETY SEATS

The present invention relates to a safety strap buckle, in particular for automotive child safety seats, as well as for push-chairs or prams.

BACKGROUND OF THE INVENTION

Safety strap buckles for automotive child safety seats are known, e.g. as described in European Patent Publication Number EP 0 867 131A1, comprising:

a buckle body connected to a first strap portion; and a click-on lock mechanism housed inside the buckle body and designed to releasably lock two tongues connected to a second and third strap portion.

In the embodiment described in the above patent application, the lock mechanism comprises a release button which is maintained, by a return spring, in an upper lock position in which the tongues are retained inside the buckle body by a rodlike retaining member engaging corresponding retaining seats defined by the two tongues.

The release button is movable, in a direction perpendicular to the insertion direction of the tongues and in opposition to the elastic force of the spring, into a lower release position, in which the retaining member is released from the seats on the tongues to permit expulsion of the tongues from the buckle body.

In the above known embodiment, the rodlike retaining member is supported by the release button, and so moves with the button between the two lock and release positions. As a result, when the tongues are inserted into the buckle body, thus moving the retaining member into the retaining seats, the release button is also moved with it and produces undesired noise.

SUMMARY OF THE INVENTION

It is an object of the present invention to provide a safety strap buckle designed to eliminate the above drawback of the known art.

According to the present invention, there is provided a safety strap buckle as claimed in the attached claims.

Very briefly, the basic idea underlying the invention is to provide a lock mechanism for a buckle of the above type, wherein the retaining member is a separate component part from the release button. Consequently, the lock stage only involves the retaining member, which engages the retaining seats on the tongues in the usual way, while the release buttons remains stationary in the rest position.

BRIEF DESCRIPTION OF THE DRAWINGS

The present invention will now be described in detail, purely by way of a non-limiting example, with reference to the accompanying drawings, in which.

DETAILED DESCRIPTION OF THE INVENTION

In the following description and accompanying drawings, only the part of the buckle containing the innovative lock mechanism is described and illustrated. For any other details, the reader is referred to the known art referred to in the introduction.

Figure 1:
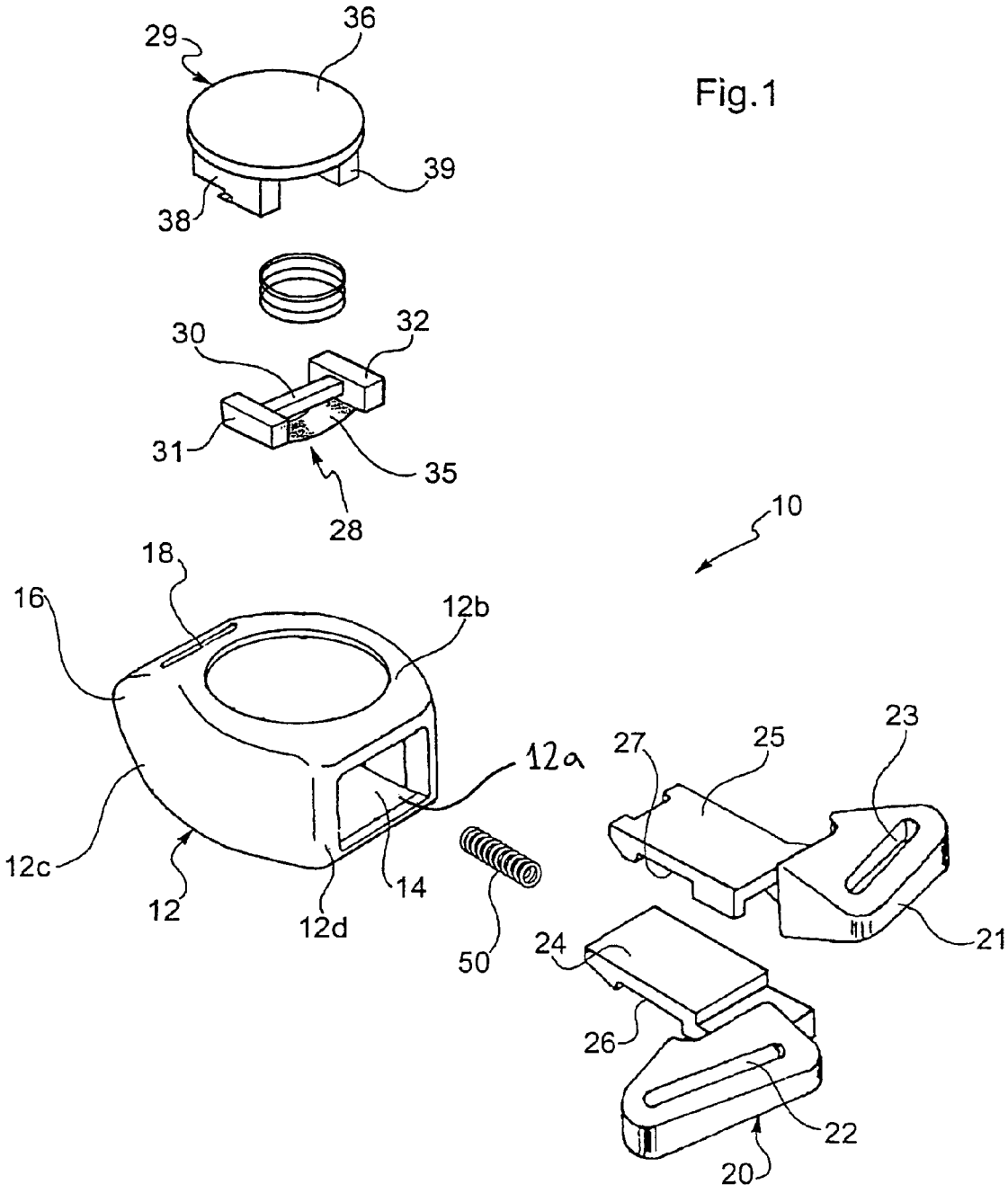
FIG. 1 shows an exploded view in perspective of a first embodiment of a safety strap buckle in accordance with the present invention.

With reference to FIG. 1, number 10 indicates as a whole a safety strap buckle in accordance with the invention, in particular for automotive child safety seats, as well as for push-chairs or prams. Buckle 10 comprises a hollow body or shell 12 in turn comprising: a substantially flat bottom wall 12*a*; a substantially flat top wall 12*b*; two lateral walls 12*c*; a front wall 12*d*; and a fastening portion 16 on the opposite side to front wall 12*d* and having a slot 18 by which to attach body 12 to a first strap portion (not shown).

Two known tongues 20 and 21 are insertable inside body 12 through an opening 14 in front wall 12*d* and in a direction substantially perpendicular to front wall 12*d* (hereinafter referred to as the longitudinal direction).

Tongues 20 and 21 are attached respectively to a second and third strap portion (not shown) by means of respective slots 22 and 23, and each comprise, in known manner, a stem portion 24, 25 having a downward-facing recess 26, 27 which acts as a retaining seat. As will be clear from the following description, a buckle in accordance with the invention may obviously also be used in retaining systems employing a different number of tongues (typically one or three).

Figure 2:
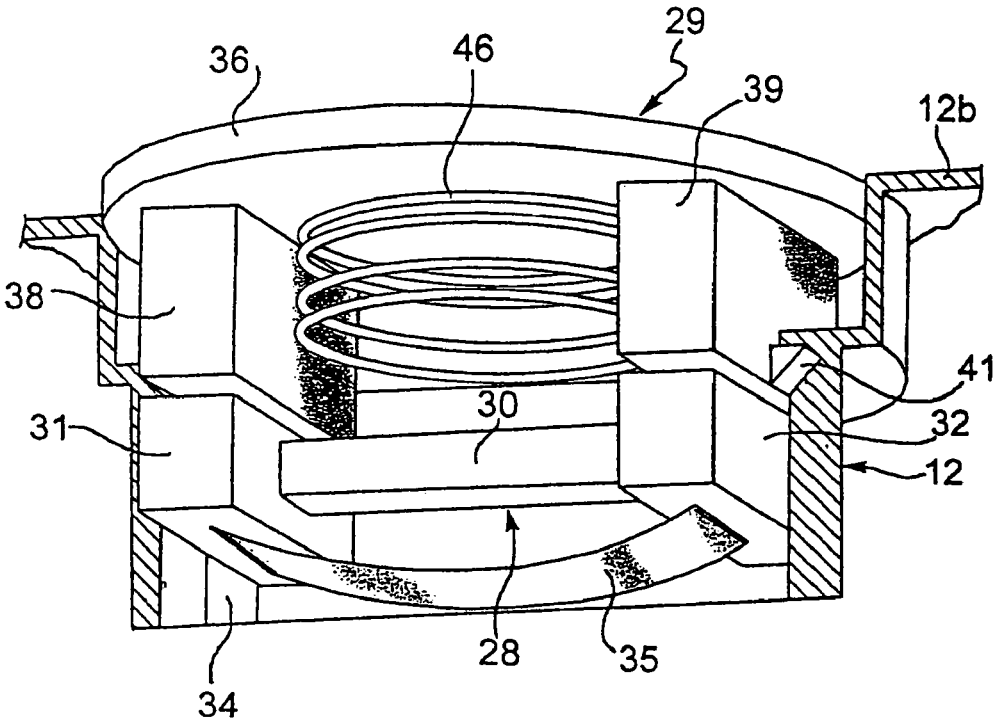
FIG. 2 shows a schematic, partly cross sectioned view in perspective of a detail of the lock mechanism of the FIG. 1 buckle.
Figure 3:
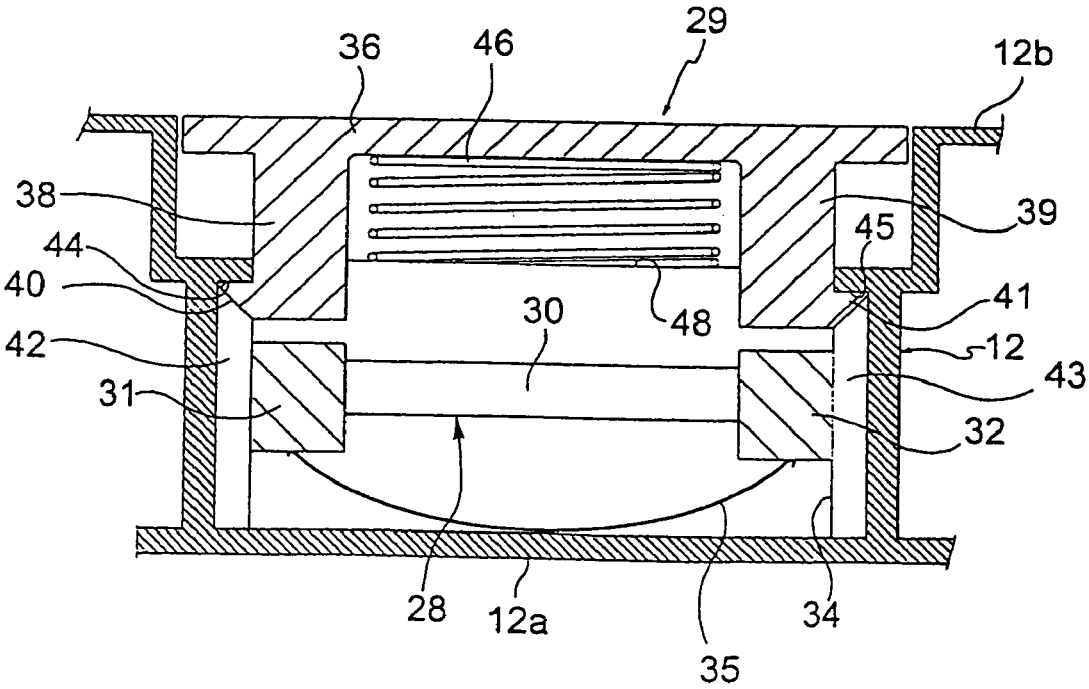
FIG. 3 shows a schematic cross section of the FIG. 2 detail.

Hollow body 12 houses the buckle click-on lock mechanism, which substantially comprises a rodlike retaining member 28 and a release button 29, both shown in detail in FIGS. 2 and 3.

With particular reference to FIGS. 2 and 3, retaining member 28 comprises a rod 30 which extends in a direction (hereinafter referred to as the transverse direction) parallel to the plane of bottom wall 12*a* of body 12 and perpendicular to the insertion direction of tongues 20 and 21, and engages retaining seats 26 and 27 in tongues 20 and 21 to retain tongues 20 and 21 inside body 12. In the example shown, rod 30 has a rectangular cross section, but may obviously have a differently shaped, preferably circular, cross section.

Retaining member 28 also comprises two guide members 31 and 32 fixed to the ends of rod 30, and which slide, in a direction perpendicular to the plane of bottom wall 12*a* (hereinafter referred to as the vertical direction), inside an appropriately shaped guide seat 34 formed in body 12. Alternatively, one guide member—in this case, annular in shape—may be provided.

The two guide members 31, 32 (or one guide member) are preferably made of plastic material. Rod 30 may be made of plastic material—in which case, it is formed in one piece with guide members 31 and 32—or of metal material—in which case, the two guide members are advantageously molded onto it.

Retaining member 28 is movable, in the vertical direction defined above, between a lowered position, in which tongues 20 and 21 can be inserted and released inside body 12, and a raised position (shown in FIGS. 2 and 3), in which, once tongues 20 and 21 are inserted inside body 12, rod 30 engages retaining seats 26 and 27 to prevent release of the two tongues.

Retaining member 28 is maintained in the raised lock position by a spring 35—in the example shown, a leaf spring, the ends of which press on guide members 31 and 32, on one side, and the central portion of which presses on bottom wall 12*a* of body 12, on the other side.

Spring 35 may obviously be a different type, e.g. a helical compression spring; in which case, two springs are preferably used, and press on the two guide members 31 and 32 at the ends of rod 30.

Button 29 comprises, in known manner, a top portion 36, e.g. disk-shaped, which is pressed by the user to release the strap; and two guide members 38 and 39 joined to (e.g. formed in one piece with) top portion 36 and mounted to slide inside guide seat 34.

The two guide members 38, 39 of button 29 advantageously comprise respective stop teeth 40, 41, which slide in respective vertical grooves 42, 43 (FIG. 3) in guide seat 34, and cooperate with respective stop surfaces 44, 45 at the top ends of grooves 42, 43 to define a top limit position (lock position) of the button.

Button 29 is maintained in the lock position by a spring 46—in the example shown, in the form of a cylindrical helical spring—interposed between disk-shaped portion 36 and a supporting surface 48 (shown schematically in FIG. 3) defined by buckle body 12.

Operation of the lock mechanism of the buckle according to the invention will now be described briefly.

When inserted inside buckle body 12 at the lock stage, tongues 20, 21 interact in known manner with rod 30 of retaining member 28, so that rod 30 engages retaining seats 26, 27 on the tongues to retain the tongues inside the buckle. Retaining member 28 being a separate component part from button 29, the button remains stationary in the lock position during the above operation, thus generating no noise. When button 29 is pressed at the release stage, on the other hand, guide members 38, 39 of the button push retaining member 28 into the lowered position, in which rod 30 disengages the retaining seats on the tongues, which are expelled in known manner from buckle body 12 by an ejector spring 50 (shown in FIG. 1).

Figure 4:
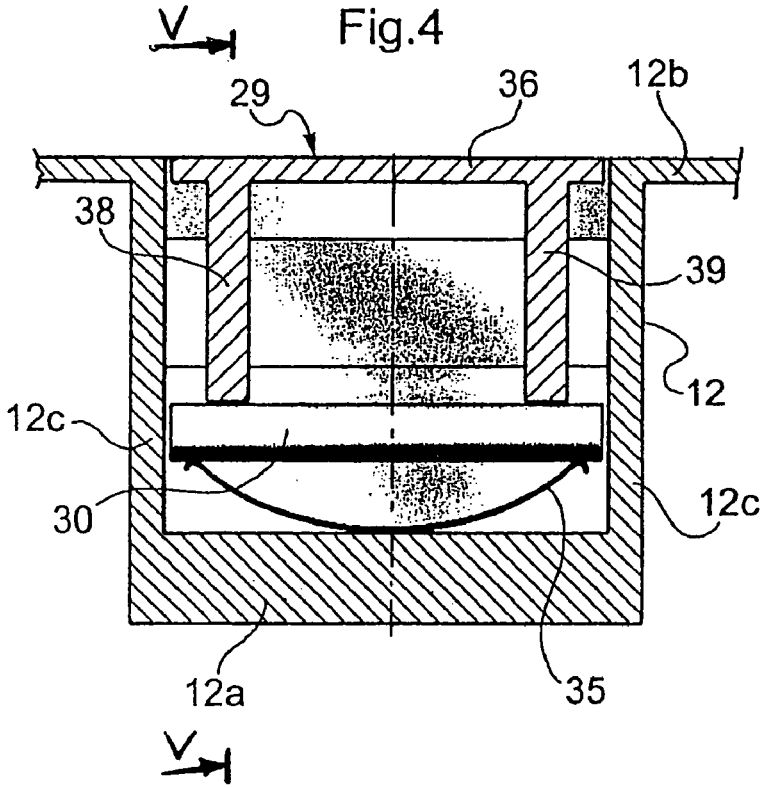
FIG. 4 shows a schematic cross section of a portion of a second embodiment of a safety strap buckle in accordance with the present invention.
Figure 5:
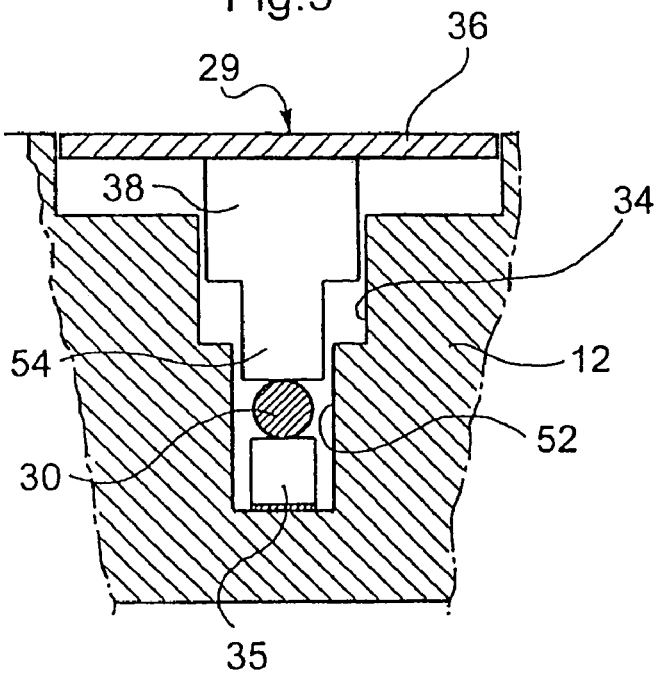
FIG. 5 shows a section along line V-V of the buckle portion in FIG. 4.

FIGS. 4 and 5 show a second embodiment of a safety strap buckle in accordance with the present invention, and in which parts identical or corresponding to those in FIGS. 1 to 3 are indicated using the same reference numbers.

The second embodiment substantially differs from the first by the rodlike retaining member only comprising rod 30, with no guide members. The ends of rod 30 slide inside respective guide seats 52 formed in hollow body 20 beneath guide seat 34 of button 29. Rod 30 is moved downwards, to release the lock mechanism, by two bottom appendixes 54 (only one shown in FIG. 5) formed by guide members 38, 39 and also sliding inside guide seats 52 of rod 30.

Figure 6:
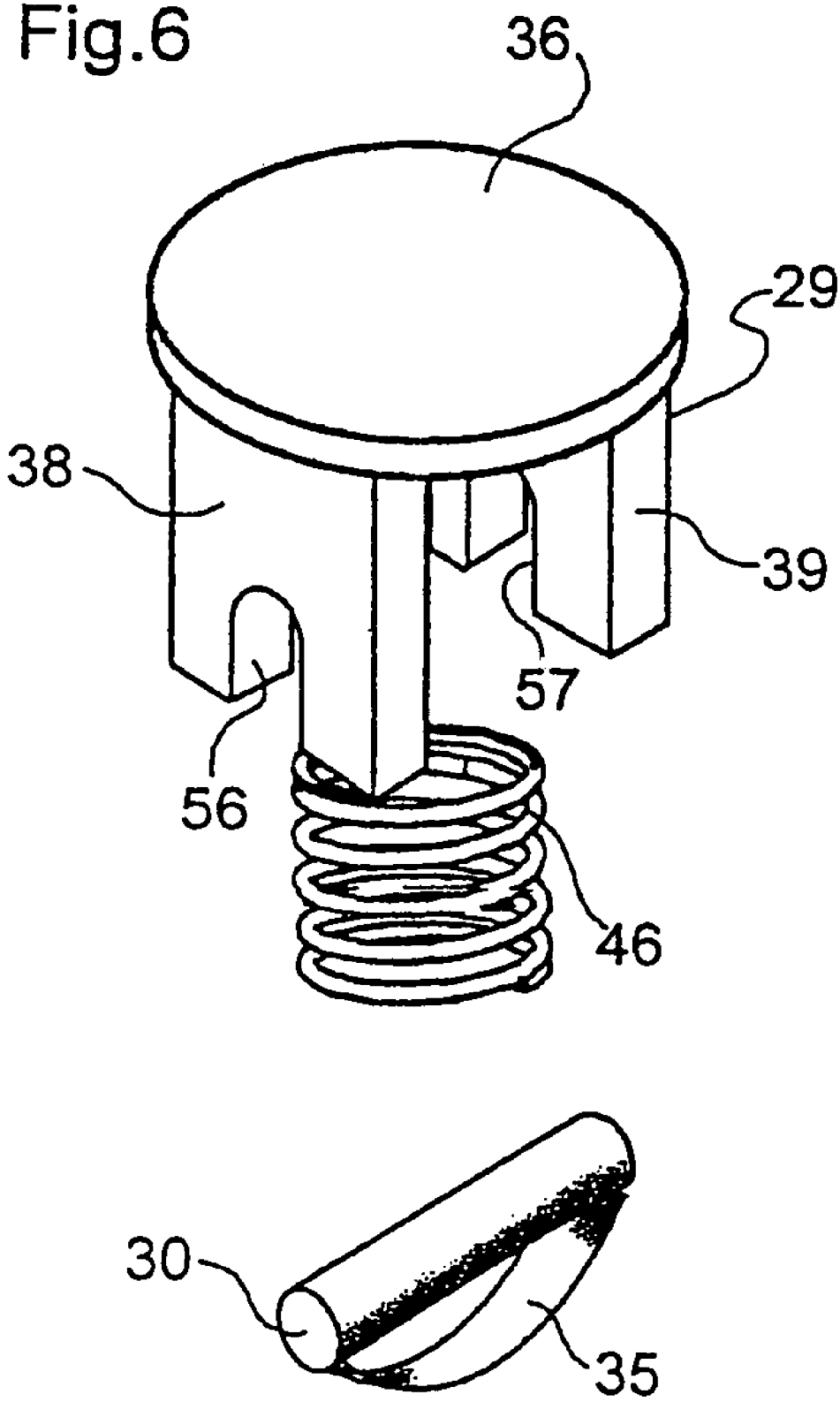
FIG. 6 shows an exploded view in perspective of a release button and a rodlike retaining member of a third embodiment of a safety strap buckle in accordance with the present invention.

FIG. 6 shows a third embodiment of a safety strap buckle in accordance with the present invention, and in which parts identical or corresponding to those in FIGS. 1 to 5 are indicated using the same reference numbers.

The third embodiment substantially differs from the second by retaining rod 30 sliding inside two guide seats 56, 57 defined by slots in respective guide members 38, 39 of release button 29.

In the second and third embodiment too, spring 35 acting on retaining rod 30 may be a leaf spring or any other suitable type. For example, two cylindrical helical springs pressing on the two ends of the rod may be used.

Figure 7:
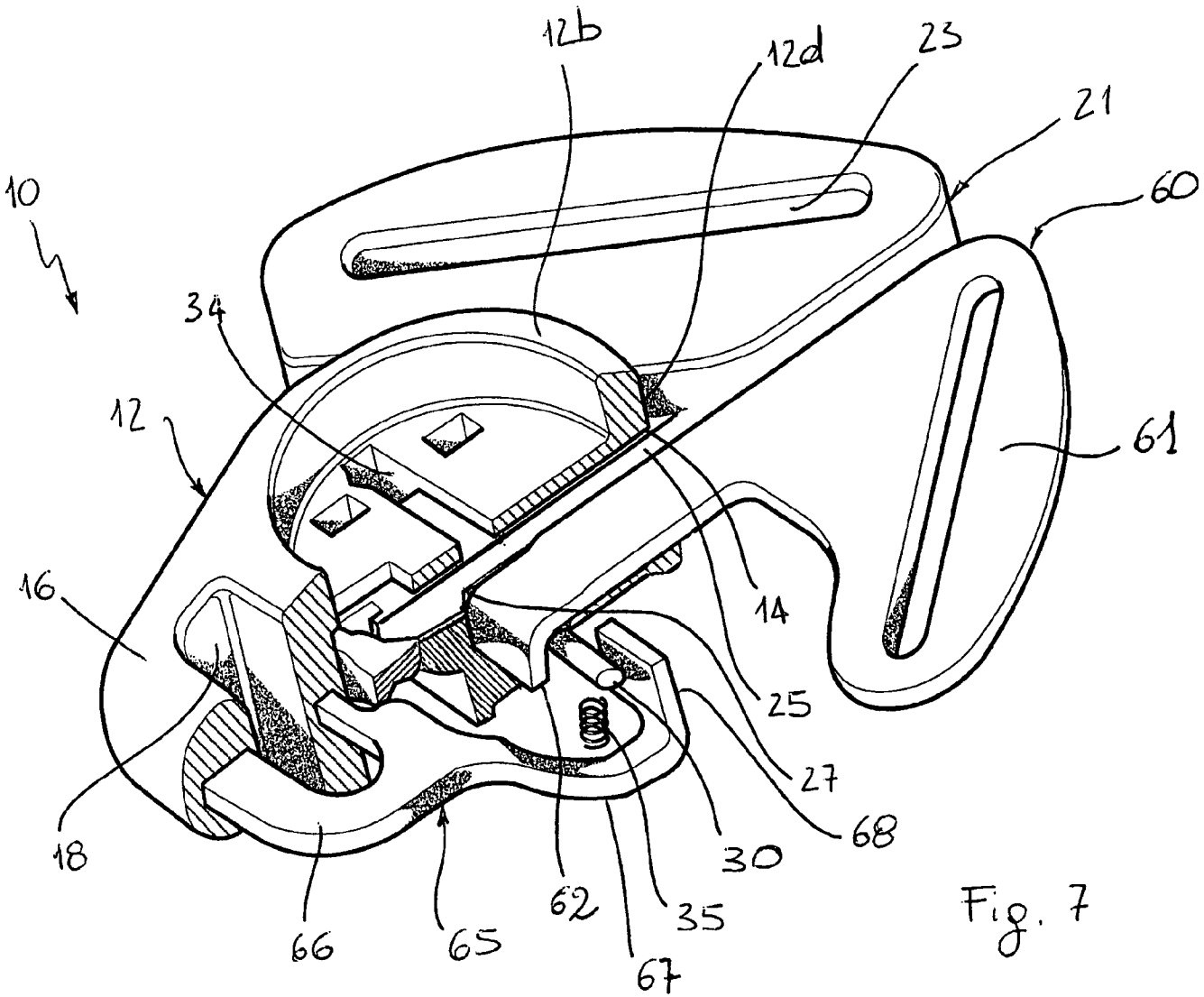
FIG. 7 shows a view in perspective, with parts removed for clarity, of a fourth embodiment of the present invention.

FIG. 7 shows a fourth embodiment of a safety strap buckle in accordance with the present invention, and in which parts identical or corresponding to those in FIGS. 1 to 6 are indicated using the same reference numbers.

The fourth embodiment differs from the FIG. 2 embodiment by two helical springs 35, as opposed to one leaf spring, acting on the ends of rod 30 to keep rod 30 in the raised lock position; and each tongue 20, 21 (only one is shown in its entirety) is formed by molding plastic material onto a respective metal reinforcing insert 60 (only one shown in FIG. 7, without plastic material). Inserts 60 are embedded completely in the plastic material, and terminate, at one end, with respective annular portions 61 surrounding slots 22, 23, and, at the other end, with respective appendixes 62 embedded in the teeth defining respective retaining seats 26, 27.

Body 12 is also formed by molding plastic material onto a metal reinforcing insert 65 (shown partly).

Metal insert 65 is embedded completely in the plastic material, and comprises : an annular end portion 66 embedded in portion 16 about slot 18; a load-transfer portion 67 defined by two arms (only one shown) and extending, from portion 66, along lateral walls 12*c* and beneath guide seats 52 (not shown in FIG. 7 but similar to those to FIG. 5) and therefore beneath rod 30 in the vertical or release direction; and two appendixes 68, which define the ends of said arms, are aligned with the ends of rod 30 in the longitudinal direction, and are located opposite guide seats 52 (i.e. on the opposite side with respect to the retaining seats 26, 27 when tongues 20, 21 engage body 12) to assist in retaining rod 30 in the event of pull on buckle 10 in the longitudinal direction.

Clearly, changes may be made to the embodiments and details described and illustrated herein purely by way of non-limiting examples, without, however, departing from the scope of the invention as defined in the accompanying claims.

The invention claimed is:

1. A safety strap buckle, in particular for automotive child safety seats, as well as for push-chairs or prams, comprising a buckle body, and a lock mechanism for releasably locking at least one tongue insertable inside said buckle body in a longitudinal insertion direction; the lock mechanism comprising:

a) a retaining rod movable, in a release direction perpendicular to said longitudinal insertion direction, between a lock position engaging said at least one tongue to retain the tongue inside said buckle body, and a release position disengaging said at least one tongue to permit expulsion of the tongue from said buckle body; and b) a release button movable in said release direction to move said retaining rod into said release position;

said retaining rod being movable in said release direction independently of said release button, and being maintained in said lock position by a spring;

wherein said buckle body is made of plastic material molded onto a metal insert, the metal insert including:

an annular end portion embedded in an annular fastening portion of said buckle body, and a load-transfer portion located beneath said retaining rod and terminating with two appendixes aligned with the ends of said retaining rod in said longitudinal insertion direction to assist said retaining rod in the event of pull on said safety strap buckle in said longitudinal insertion direction.

2. A buckle as claimed in claim 1, wherein said retaining rod is fixed at the ends to at least one guide member, which slides in said release direction inside a guide seat formed by said buckle body.

3. A buckle as claimed in claim 1, wherein said retaining rod is guided inside two guide seats formed by said buckle body.

4. A buckle as claimed in claim 1, wherein said retaining rod is guided inside two guide seats formed by said release button.

5. A buckle as claimed in claim 2, wherein said spring presses on said at least one guide member of said retaining rod.

6. A buckle as claimed in claim 3, wherein said spring presses directly on said retaining rod.

7. A buckle as claimed in claim 2, wherein said release button has at least one guide member which slides in said release direction inside said guide seat.

8. A buckle as claimed in claim 7, wherein said at least one guide member of said release button comprises a respective stop tooth cooperating with a respective stop surface at one end of said guide seat.

9. A buckle as claimed in claim 1, wherein said release button is maintained in said lock position by a spring interposed between said release button and said retaining rod, wherein the spring maintaining said release button in said lock position is separate from the spring maintaining said retaining rod in said lock position.

* * * * *